US007073530B2

(12) United States Patent
Pyle et al.

(10) Patent No.: US 7,073,530 B2
(45) Date of Patent: Jul. 11, 2006

(54) STORAGE TANK DE-INVENTORYING

(75) Inventors: Mark A. Pyle, Baytown, TX (US); Randell L. Dodd, Crosby, TX (US)

(73) Assignee: Equistar Chemicals, LP, Houston, TX (US)

( * ) Notice: Subject to any disclaimer, the term of this patent is extended or adjusted under 35 U.S.C. 154(b) by 363 days.

(21) Appl. No.: 10/686,457

(22) Filed: Oct. 15, 2003

(65) Prior Publication Data

US 2005/0081925 A1 Apr. 21, 2005

(51) Int. Cl.
*F16K 24/00* (2006.01)

(52) U.S. Cl. ..... 137/587; 220/88.3; 220/221; 220/224; 220/227

(58) Field of Classification Search ..... 137/581, 137/587; 220/88.3, 220, 221, 227, 224
See application file for complete search history.

(56) References Cited

U.S. PATENT DOCUMENTS

| | | | | | |
|---|---|---|---|---|---|
| 1,596,526 | A | * | 8/1926 | Griffin | 137/326 |
| 1,979,272 | A | * | 11/1934 | Kramer | 220/219 |
| 2,049,987 | A | * | 8/1936 | Willenborg | 220/88.3 |
| 3,329,301 | A | * | 7/1967 | Lee et al. | 220/227 |
| 3,910,452 | A | * | 10/1975 | Szasz | 220/226 |
| 4,244,487 | A | * | 1/1981 | Kern | 220/216 |
| 5,147,418 | A | * | 9/1992 | Laverman et al. | 95/90 |
| 5,220,799 | A | * | 6/1993 | Lievens et al. | 62/48.2 |
| 5,372,497 | A | * | 12/1994 | Coolidge et al. | 431/6 |

* cited by examiner

*Primary Examiner*—Eric Keasel
*Assistant Examiner*—Craig J. Price
(74) *Attorney, Agent, or Firm*—Roderick W. MacDonald

(57) ABSTRACT

A method for emptying a liquid storage tank that has a floating roof which becomes stationery a finite distance above the tank bottom, wherein, after the roof becomes stationery, liquid is continued to be withdrawn from inside the tank while vapor is removed from within the tank in a contained manner and an inert gas is introduced into the tank for pressure maintenance purposes.

10 Claims, 8 Drawing Sheets

STORAGE TANK DE-INVENTORYING

BACKGROUND OF THE INVENTION

1. Field of the Invention

This invention relates to the removal of the liquid and vapor content (inventory) of a storage tank and, more particularly, to a liquid storage tank having a floating roof.

2. Description of the Prior Art

Floating roof storage tanks are designed so that the roof of the tank floats on top of the liquid inventory stored in the interior of the tank, and floats downwardly toward the bottom of the tank as that liquid is withdrawn from the tank for other disposition.

The floating roof has at least one dynamic seal between it and the tank wall or walls to prevent vapor from the liquid inventory from escaping to the ambient atmosphere that is present over the roof and outside the tank's interior.

Such a roof carries with it a plurality of legs which stop the roof and hold it stationery a finite distance above the tank bottom so that once the liquid is essentially completely removed from the tank, workmen can enter, through man ways, the tank's interior below the stationery roof. The workmen can then carry out cleaning and/or maintenance projects on the interior sides of the tank's walls, bottom, and/or roof. Thus, for this purpose, the roof can be stopped and held as much as seven feet apart from and above the bottom.

When the roof is first brought to rest on its support legs, a substantial volume of liquid and some related vapor remains in the tank, both of which must be removed before workmen can gain access to the interior of the tank while the roof is held stationery.

Simple removal of this remaining liquid tends, because of the seal between the roof and the tank walls, to create a vacuum within the tank which can damage the tank and/or roof itself if the potential to form a vacuum is not addressed and controlled.

Heretofore, vents carried by the roof were opened while liquid was removed from the interior of the tank under the stationery roof in order to allow ambient air to enter that interior, equalize the pressure therein, and otherwise prevent the formation of a vacuum therein. When this technique is used, vapor, particularly vapor from inventory liquid, escapes to the ambient atmosphere during the entire time period it takes to essentially fully de-inventory the tank. Such a time period can extend to several days because such tanks can be so large in interior volume and the roof becomes stationery a number of feet above the tank bottom. Thus, a substantial volume of vapor can enter the ambient atmosphere during this final emptying or de-inventorying step. This can be unacceptable under the then existing emissions standards for the location and nature of the stored liquid inventory, and particularly when such liquid is hydro carbonaceous in nature.

It is, therefore, desirable to be able to essentially completely de-inventory a floating roof tank with minimal emission of interior tank vapor to the ambient atmosphere around the tank, and without damaging the tank or roof in the process.

SUMMARY OF THE INVENTION

In accordance with this invention there is provided a method wherein, after a floating roof becomes stationery, all or essentially all the remaining liquid inventory in the tank is removed while vapor is removed through at least one vent, the vapor being removed in a contained manner. The thus captured and contained vapor is conducted to at least one thermal oxidizer wherein it is essentially converted into compounds that are acceptable for emission into the ambient atmosphere, the exhaust of the thermal oxidizer thereby being essentially the only material exhausted into the ambient atmosphere during the process of the invention.

During the process of this invention, inert gas is introduced in a controlled manner into the interior of the tank for pressure equalization purposes to prevent tank/roof damage, whereby the tank is essentially de-inventoried to an extent that allows human access to the interior thereof without appreciable loss of vapor to the ambient atmosphere and without structural tank/roof damage.

DETAILED DESCRIPTION OF THE INVENTION

Figure 1:
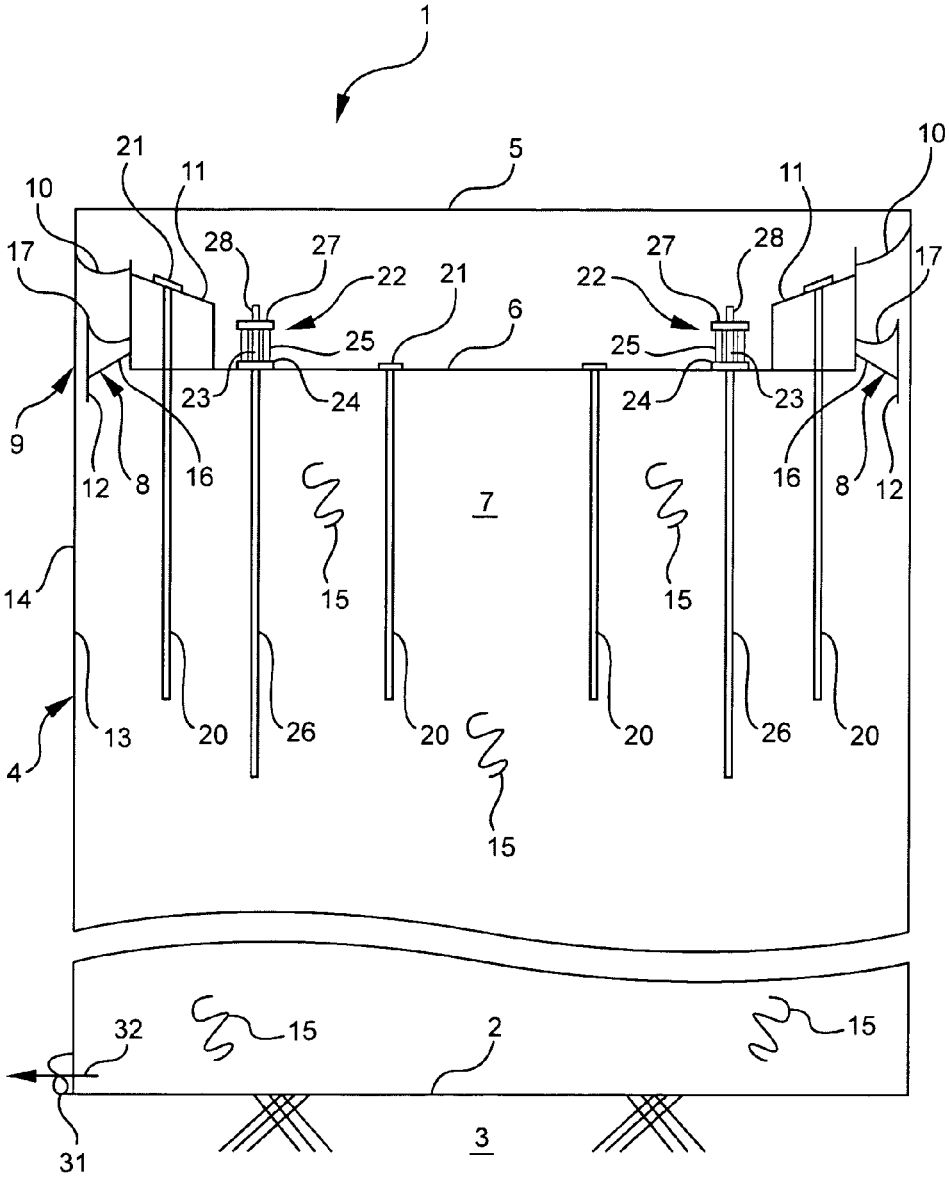
FIG. 1 Prior Art
FIG. 1 shows a vertical cross-section of a typical floating roof storage tank with its roof floating at the top of the tank's interior.

FIG. 1 shows a tank 1 having a bottom 2 resting on the earth's surface 3, and supporting upstanding wall 4 which is usually, but not necessarily, curvilinear in configuration. Wall 4 has an inner side 13 exposed to the interior of the tank and an outer side 14 exposed to the ambient atmosphere outside of the tank. For sake of simplicity and clarity of this description, tank wall 4 is essentially circular in configuration as is bottom 2. Wall 4 defines an opposed, open circular top 5 which carries in its interior area a circular floating roof 6. Bottom 2, wall 4, and roof 6 thereby define interior volume 7 of tank 1 which is used for containing and storing inventory liquid 15. In FIG. 1, liquid 15 extends from bottom 2 to roof 6 so that interior 7 is essentially liquid full with roof 6 floating on top of the upper surface of the inventory.

Tank 1 can typically be very large. Although actual tank and related equipment dimensions are not critical to this invention, they will be given in order to convey a sense and an example of the physical size of such a tank, the relative size of its components since the Figures are not to scale, and the volume of liquid that interior 7 is capable of holding. Bottom 2 can routinely be 160 feet in diameter, with upstanding side 4 being 48 feet high. Roof 6 can be 158 feet in diameter thereby leaving a ring shaped space 8 about 1 foot across that extends completely around the round circumference of the roof. This ring opening is employed in order to accommodate a seal or seals that are used to enclose interior 7 in a vapor tight manner.

Although a wide variety of seal configurations can be used in ring space 8, FIG. 1 shows a conventional arrangement wherein a primary seal 9 is employed below a secondary seal 10.

Roof 6 is composed primarily of metal plate less than 1 inch in thickness, typically 5/16 to ½ inch in thickness when made of steel plate. To make roof 6 more buoyant, a hollow, liquid tight pontoon structure 11 is employed around the outer periphery of the roof. Pontoon 11 can vary in height from 2 to 4 feet and 6 feet across. Seals 9 and 10 are fixed to pontoon 11.

Primary seal 9 is composed of an upstanding metal plate 12 that extends continuously around the entire inner side 13 of wall 4. Plate 12 is shown in the Figure to be spaced apart from side 13 only for sake of clarity. In reality, plate 12 abuts side 13 so that this primary seal is a metal to metal seal between plate 12 and the entire circumference of side 13. Plate 12 is roughly 1 foot high along wall 4, about one-half inch thick, and is supported by a conventional spring biased member 16 which is biased to force plate 12 firmly against side 13. Seal 9 carries over the top thereof from plate 12 to pontoon 11 a continuous ring of rubberized fabric 17 that is impervious to vapor present in interior 7 of the tank, e.g., vapor already present, formed from, or otherwise related to the liquid inventory in interior 7 as well as other vapor that might have found its way into interior 7. Thus, by way of seal 9 and its fabric cover 17, vapor in interior 7 that reaches space 8 is contained therein and not allowed to escape to the ambient atmosphere present above roof 6 and adjacent side 14, even as roof 6 floats downwardly as inventory is removed from interior 7.

To help ensure a reliable vapor seal between wall 4 and roof 6, a secondary back-up seal 10 is employed. In this Figure, seal 10 is a conventional spring metal member which, when fixed to pontoon 11 as shown in FIG. 1, is normally biased against side 13. Seal 10 can be composed of a plurality of metal, e.g., stainless steel, segments, the gaps between adjacent segments being sealed with rubber grommets.

Accordingly, vapor that is present in or is later formed in interior 7 is essentially kept inside interior 7 during storage. Such vapor is also kept inside interior 7 when inventory 15 is removed from interior 7 by way of pipe 31 as shown by arrow 32. Roof 6 moves downwardly toward bottom 2 as the top surface of the liquid inventory moves downwardly in response to inventory removal via pipe 31.

Roof 6 carries integral therewith a plurality of roof support legs 20 which are fixed to roof 6 by way of individual metal support pads 21 which are about 1 foot across (1 foot in diameter if round). Legs 20 extend essentially equidistantly from roof 6 into interior 7. Since roof 6 is primarily composed of metal plate less than an inch in thickness, a plurality of roof legs is employed throughout the underside area of roof 6 for ample roof support when legs 20 engage bottom 2 with the full weight of the roof assembly. For example, with the 158 foot diameter roof already mentioned, upwards of 100 such roof legs can be used.

Figure 2:
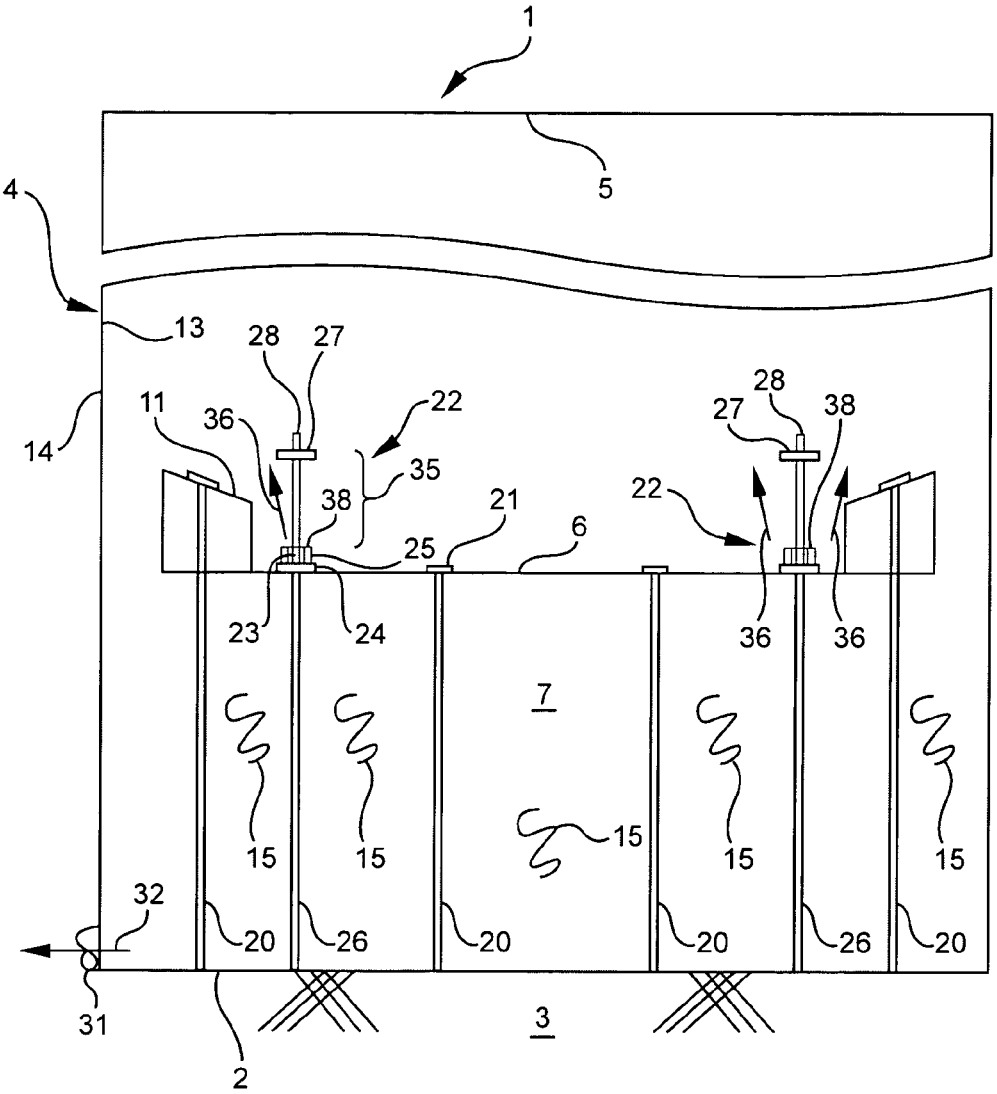
FIG. 2 Prior Art
FIG. 2 shows the tank of FIG. 1 after liquid inventory has been removed to the extent and only to the extent that the floating roof has become stationery by resting its support legs on the tank bottom.

Legs 20 extend downwardly from roof 6 a distance sufficient to stop and hold roof 6 stationary a finite distance above and apart from bottom 2, as shown in FIG. 2. This is so that when roof 6 is in a stationery mode, workmen can have physical access through at least one open man way (not shown) into the portion of interior 7 that is left between stationery roof 6 and bottom 2. The workmen can then perform various tasks in that portion of interior 7 while tank 1 is essentially empty of inventory. Thus, the space often left between stationary roof 6 and bottom 2 can be at least about 7 feet. It can be seen that with a tank having a 160 foot diameter, a substantial amount of liquid inventory is left in interior 7 if such space is 7 feet tall.

Figure 3:
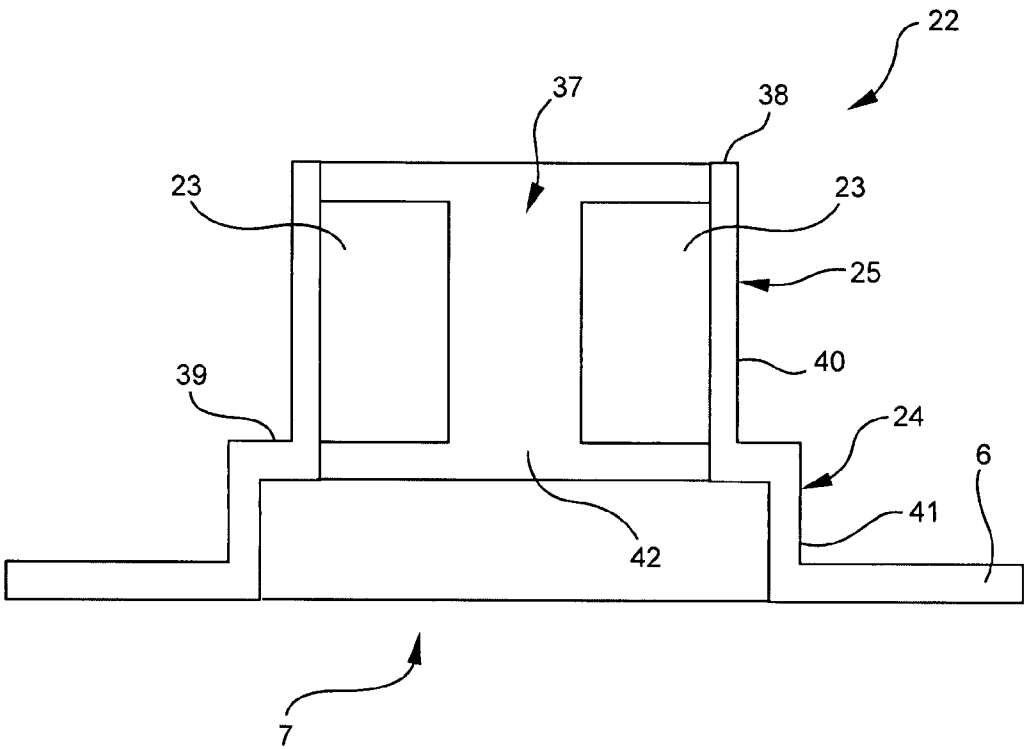
FIG. 3 Prior Art
FIG. 3 shows a vertical cross-section of a typical vent on the floating roof shown in FIG. 1.

Roof 6 also carries a least two vents 22. Each such vent is composed of an upstanding closed reinforcing housing 24 which has an aperture in the top thereof as shown in FIG. 3. Housing 24 can be about 2 feet across (1 foot in diameter if round in configuration) and about 1 foot high. Each housing 24 carries integral with the top thereof a smaller lateral cross section, upstanding open vent cap support member 25 which is about 10 inches across or in diameter, and 11 inches high.

Extending in a sliding manner through the aperture of housing 24 and member 25 of each of vents 22 is a vent leg 26. Legs 26 carry a vent cap 27 that is movable along the length of leg 26. Because of the weight of leg 26 and, optionally, an elastic seal (not shown) on the under side of cap 27, vents 22 are normally sealed against the loss of vapor from interior 7 to the ambient atmosphere. Caps 27 are made to be movable in a vapor sealed manner, along the length of legs 26 so that cap 27 can be adjusted to be carried anywhere desired along the length of leg 26. This allows one to vary the length of legs 26 that extends into interior 7. This way, legs 26 can be made to be longer than legs 20 so that legs 26 will reach and abut bottom 2 before legs 20. For example, if legs 20 extend 7 feet into interior 7, caps 27 can be moved along the length of legs 26 so that legs 26 extend 8 feet into interior 7 when cap 27 abuts member 25 as shown in FIG. 1. Any excess length of legs 26 beyond 8 foot is left to extend above caps 27 as shown at 28. Members 25 carry internally thereof at least one centralizing means such as guide vane 23 which serves to keep legs 26 essentially upright but movable within elements 24 and 25. Support legs 20 and vent legs 26 can be formed from steel pipe 2.5 to 3 inches in diameter.

FIG. 2 shows tank 1 of FIG. 1 after inventory has been removed sufficiently that roof 6 has moved downwardly until legs 20 and 26 have come into contact with bottom 2.

For sake of clarity, seal means 9 and 10 have been omitted from FIG. 2, but would be in place as shown in FIG. 1 in normal operation.

In FIG. 2, since all of legs 20 and 26 abut bottom 2, roof 6 is stationery at about 7 feet above bottom 2, and the excess foot of length of legs 26 that initially extended into interior 7 in FIG. 1 now instead extends above the top 38 of member 25 as shown at 35. Similarly caps 27 are now carried one foot above the top end or edge 38 of member 25 thereby opening interior 7 to the ambient atmosphere and allowing vapor to leave interior 7 as shown by arrows 36. If legs 26 were left in this position during the entire time it takes to remove the remaining inventory liquid 15 from under stationery roof 6, a substantial amount of vapor can escape into the ambient atmosphere since fully emptying tank 1 after roof 6 becomes stationery can take days.

In the practice of this invention, once roof 6 becomes stationery, legs 26 and caps 27 are physically removed in their entirety from inside tank 7, housing 24 and member 25 thereby leaving the open top of member 25 fully exposed and open to the ambient atmosphere. This is shown in FIGS. 3 and 4 wherein the open top of member 25, as defined by the upper end 38 of member 25, is shown at 37.

Figure 4:
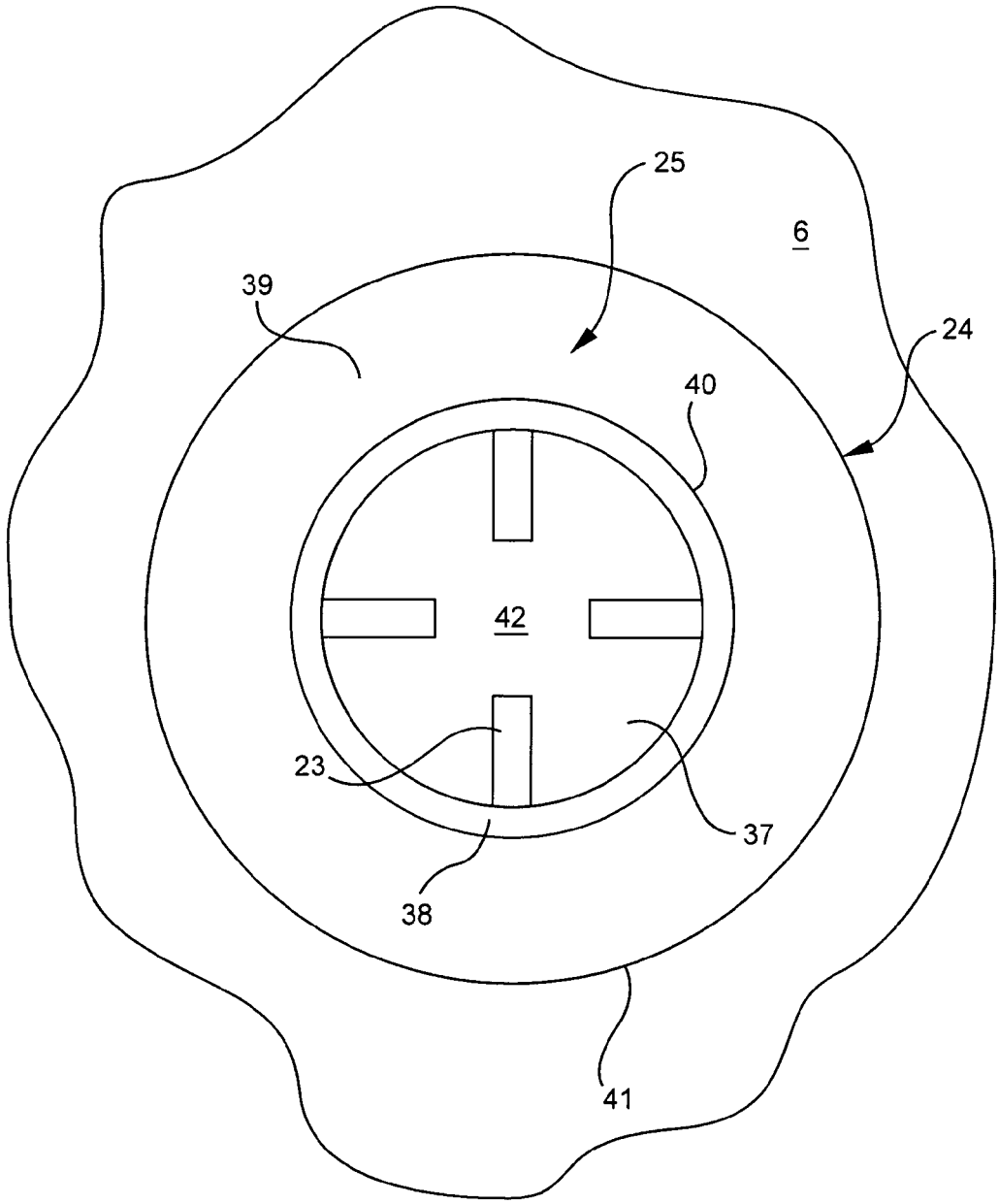
FIG. 4 Prior Art
FIG. 4 shows a top view of the vent of FIG. 3.

FIGS. 3 and 4 also show that there is a lateral surface 39 that extends between the outer side 40 (ambient atmosphere side) of member 25 and the outer side 41 of housing 24. These Figures also show a plurality of centralizers 23 spaced around the inner periphery of member 25 which define the opening 42 through which leg 26 passes when in place as shown in FIGS. 1 and 2.

Figure 5:
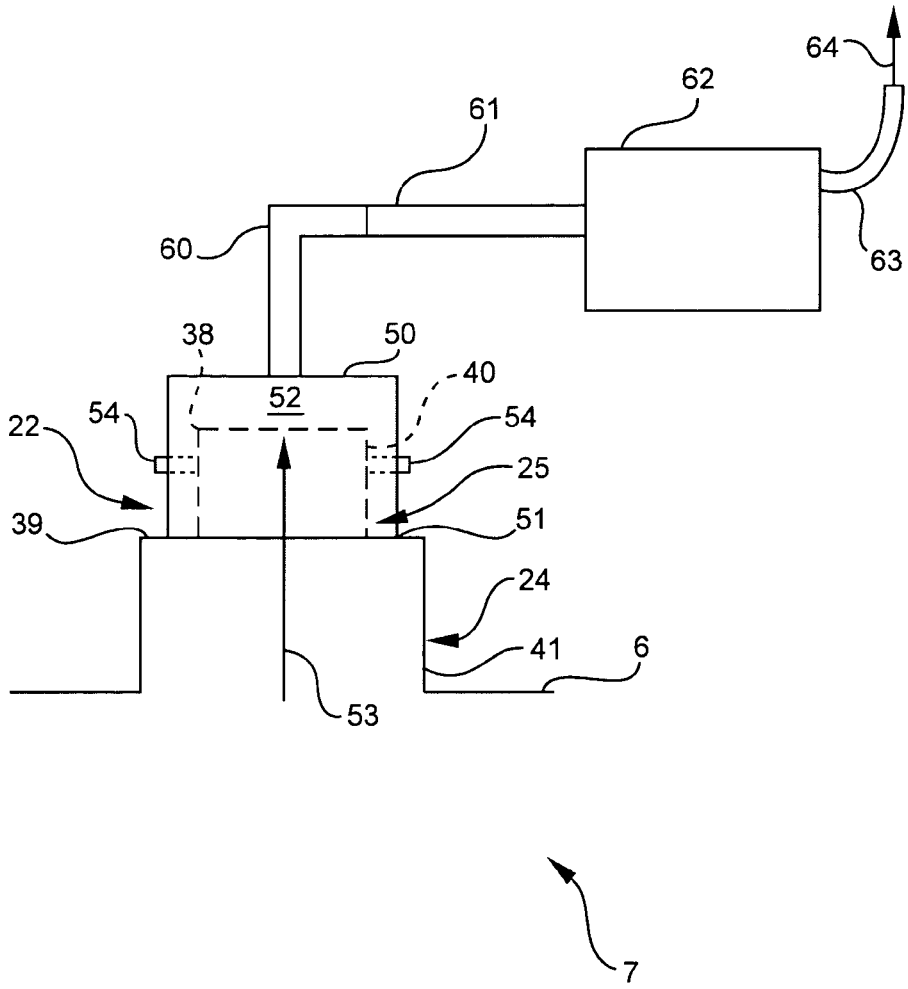
FIG. 5 shows a vent such as that of FIGS. 3 and 4 fitted with a first device useful in the practice of this invention for removing vapor from the interior of the tank of FIG. 1 in a controlled manner and oxidizing that captured vapor.

In accordance with this invention, when leg 26 is completely removed from within opening 42 of at least one of vents 22, a separate closed housing 50, FIG. 5, is promptly placed over member 25 to enclose same in a vapor tight manner. Housing 50 has an open bottom defined by a lower end or edge 51 which is the same in appearance as edge 38 of member 24 but of larger diameter than member 25 and oriented downwardly. Thus housing 50 can pass around the outer periphery of edge 38 and member 25 itself until its end 51 abuts lateral surface 39 of housing 24. Housing 50 fully encloses member 25 in its interior 52. By this step, vapor 53 which was heretofore trapped in interior 7 is allowed to leave interior 7 in a contained manner. The thus captured vapor is passed by way of pipe 60, which can be integral with housing 50, through a quick coupling, not shown, to a removable hose or other conduit 61 which is connected to the fuel intake of at least one thermal oxidizer 62. In oxidizer 62, the components of the contained vapor are combusted or otherwise transformed into more benign materials such as water and carbon dioxide, and exhausted, as shown by arrow 64, to the ambient atmosphere by way of exhaust pipe 63.

Oxidizer 62 can be any device that converts vapor 53 to a composition more suitable for emission to the ambient atmosphere. For example, for hydro carbonaceous vapor, such as that obtained from automotive gasoline or other liquids containing hydrocarbon molecules up to 12 carbon atoms per molecule, oxidizer 62 can be at least one internal combustion engine tuned to combust the particular chemical composition of vapor 53 with a minimum efficiency of at least about 95% combustion. Combustion efficiencies can readily reach 98% to 99% for hydrocarbons. As a further example, when vapor 53 contains a substantial amount of propane, a conventional internal combustion engine can be modified in known manner to operate on a propane based fuel with 98% to 99% complete combustion of the propane so that the exhaust of this engine is primarily water and carbon dioxide. Such oxidizers are known in the art and commercially available from suppliers such as Weeco International. One or more oxidizers 62 can be employed in order to maintain the maximum efficient combustion rate for the amount of vapor 53 being removed from the tank consistent with the most desirable chemical composition of exhaust emissions 64 for release to the ambient atmosphere.

Housing 50 can be physically, removably fixed to member 25 by one or more fasteners 54 such as threaded bolts or all-thread members that can be screwed in a vapor sealing manner through housing 50 into contact with member 25. Housing 50 can also carry at its lower edge 51 an elastic seal which extends between edge 51 and surface 39 to ensure a vapor tight seal between housing 50 and roof 6. The use of threaded metal fasteners 54 can eliminate the need for a separate electrical ground device for housing 50, although such a device can be employed along with fasteners 54, if desired, or if no fasteners 54 are employed.

Figure 6:
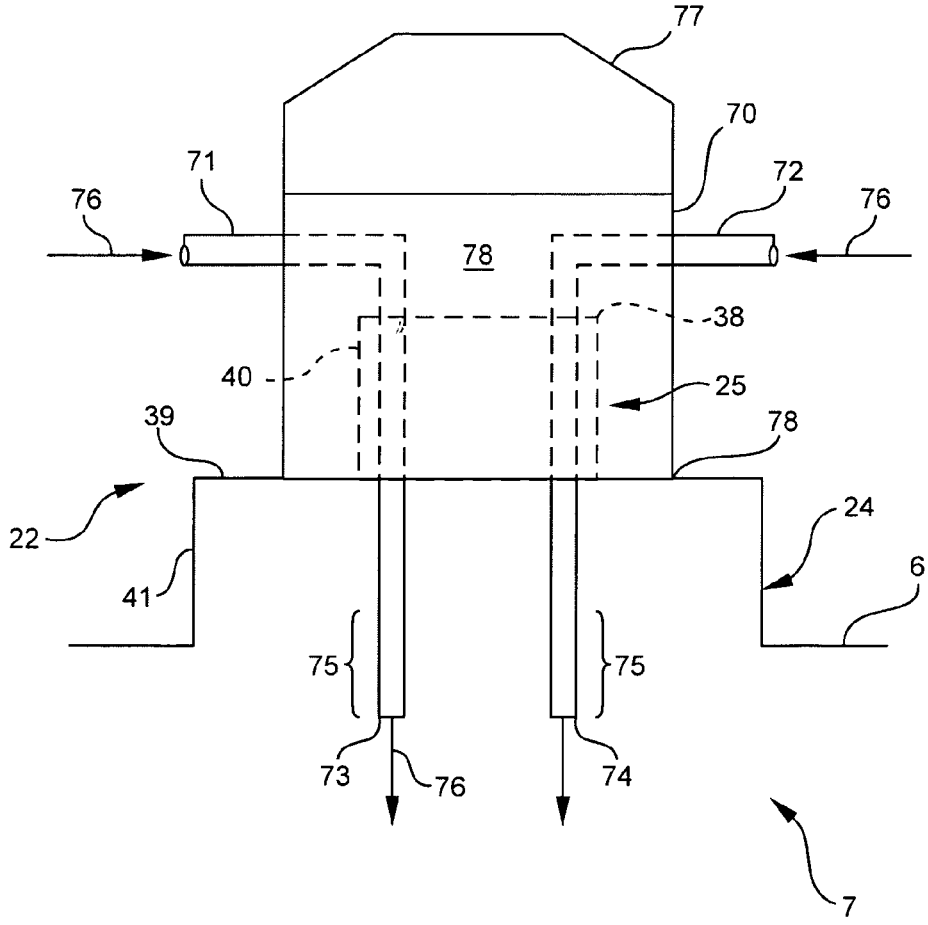
FIG. 6 shows a vent such as that of FIGS. 3 and 4 fitted with a second device useful in the practice of this invention for equalizing the pressure within the interior of the tank of FIG. 2 below the stationery roof while liquid inventory is removed from same.
Figure 7:
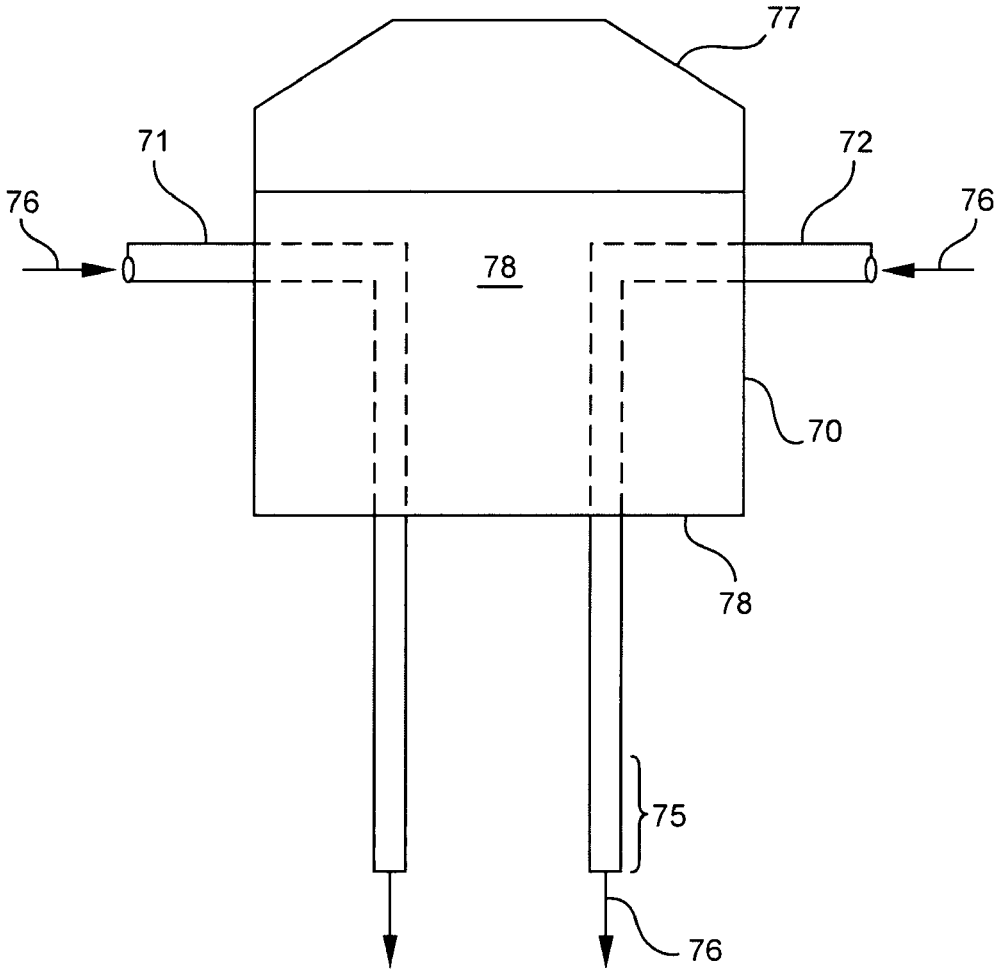
FIG. 7 shows the second device of FIG. 6 when removed from the vent.

Contemporaneously with the removal of vapor from tank 1 in a contained manner as described above for FIG. 5, a separate vent 22 is similarly modified by removal of its leg 26. As shown in FIG. 6, member 25 of this particular vent is covered with a different housing 70. Housing 70 is similar to housing 50 of FIG. 5. Housing 70 has a lower end or edge 78 similar to edge 51 of housing 50. Edge 78 rests on lateral surface 39 in a manner similar to that of housing 50. Edge 78 can also carry elastic seal means to help ensure a vapor tight connection with roof 6. If desired, housing 70 can be fixed to member 25 with removable threaded fasteners (not shown) in the same manner as shown for fasteners 54 of FIG. 5.

Housing 70 differs substantially in operation from housing 50. For example, instead of carrying at least one three inch internal diameter pipe 60 on its top surface, housing 70 can carry at least one pipe which, when housing 70 is in place on a vent 22, is in direct fluid communication with interior 7 below housing 24 and roof 6. FIG. 6 shows, as an example, two such one inch internal diameter pipes 71 and 72 extending through the upstanding wall of housing 70. The number and placement of pipes 60, 71, and 72 is not critical to the operation of this invention.

In FIG. 6, housing 70 is shown to carry integrally there with pipes 71 and 72, both of which are spaced above and of such lateral length that they reach over edge 38, and such vertical length that they pass into, and open directly into, interior 7 well below roof 6 and vent 22. Pipes 71 and 72 are sized in their vertical length so that their lower ends 73 and 74, respectively, extend below roof 6 into interior 7 as shown at 75. Distance 75 is sufficient so that as a gas is introduced through pipes 71 and 72 an over pressure or vacuum is not created inside vent 22. Distance 75 can be, for example, at least about 3 inches. As inventory liquid is continued to be withdrawn from interior 7 after roof support legs 20 have bottomed out on bottom 20 and vapor is removed as described with reference to FIG. 5 above, the upper liquid level of the inventory separates from now stationery roof 6.

This action can tend to form a vacuum in interior 7. To prevent this, at least one inert gas is introduced into interior 7 by way of pipes 71 and 72 to equalize the pressure in interior 7 with that of the ambient atmosphere. Inert gas thus takes the place of inventory vapor as tank 1 is essentially completely emptied of inventory liquid and trapped vapor. By the time the tank is sufficiently empty to allow access to interior 7, essentially all of the inventory vapor has also been removed in a contained manner and converted to a benign exhaust acceptable for introduction into the ambient atmosphere. Housings 50 and 70 can be left in place during tank clearing and cleaning by workmen operating inside emptied tank 1 below stationery roof 6.

Housing 70 can carry a conventional pressure valve relief valve 77 which senses the pressure or lack thereof in the interior 78 of housing 70 of FIG. 6. Such measurement is carried out during the inventory liquid and vapor removal steps described above. Valve 77 is normally closed, but, when open, it establishes fluid communication between interior 7 and the ambient atmosphere by way of interior 78. Valve 77 is set to open such fluid communication to the ambient atmosphere if a predetermined over pressure or vacuum level is reached in interior 78. Inert gas 76, if introduced directly into vent interior 78, could create a false over pressure or vacuum reading that is not representative of the actual conditions in interior 7. This is why inert gas 76 is introduced by pipes 71 and 72 into interior 7 and not into interior 78. By introducing inert gas into the larger volume of interior 7, relative to the small volume of interior 78, the possibility of false readings by valve 77 is eliminated. Pressure valve relief valves are well known and commercially available.

Figure 8:
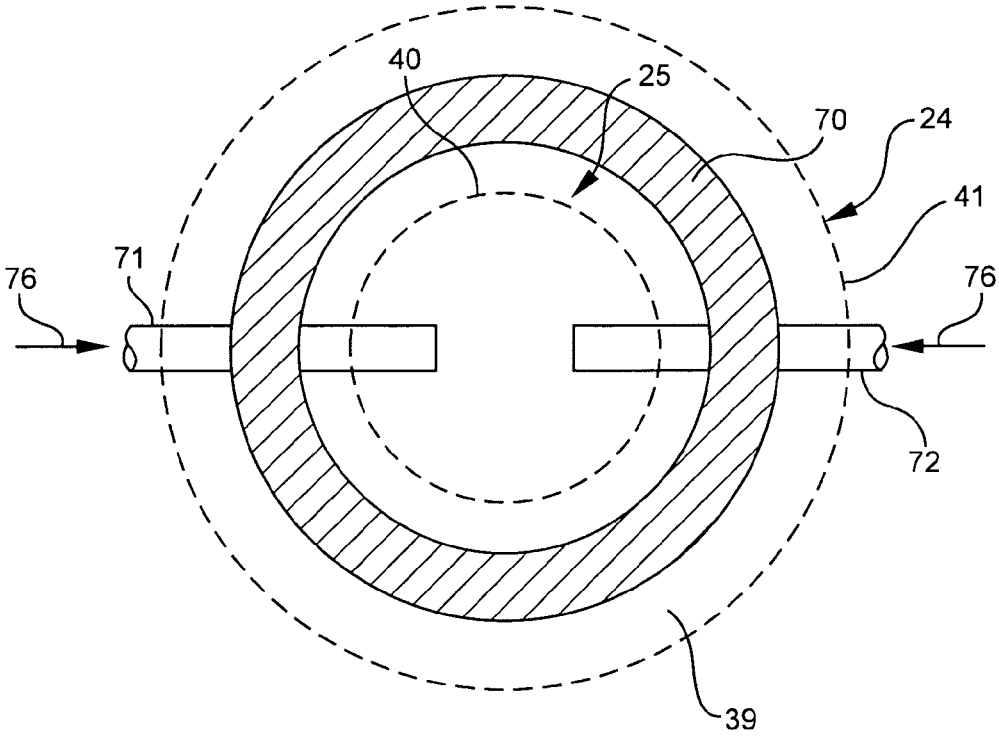
FIG. 8 is a top view of the device of FIG. 6 when fitted on to the vent of FIG. 6.

FIG. 8 shows a top cross-sectional view of FIG. 6 with the top of housing 70 and valve 77 removed. It can be seen that housing 70 surrounds and encloses member 25 while pipes 71 and 72 extend laterally into the interior of member 25. Housing 50 is of a similar configuration as housing 70, and surrounds member 25 in the same manner shown in FIG. 8 for housing 70.

EXAMPLE

A storage tank such as that described above and shown in the Figures is filled with conventional automotive gasoline which will ultimately be sold commercially to the motoring public.

After sufficient inventory, gasoline is removed from tank 1 for roof 6 to become stationery as described above, and gasoline is continued to be removed from tank 1 by way of conduit 31. At the same time, gasoline vapor is removed from interior 7, contained by housing 50, and transferred by way of conduits 60 and 61 to oxidizer 62 at the rate of about 200 standard cubic feet per minute (cfm). To maintain an equilibrium pressure in interior 7 with that of the ambient atmosphere, plant nitrogen at about 45 psig is introduced by way of pipes 71 and 72 at essentially the same 200 cfm rate.

Oxidizer 62 is a conventional internal combustion engine modified to start running on propane as fuel and then to be switched over to operate on the gasoline vapor being removed from interior 7. Oxidizer 62 combusts gasoline vapor with an efficiency of about 99% so that its exhaust to the ambient atmosphere is essentially water and carbon dioxide.

By this process, tank 1 is essentially completely emptied of inventory gasoline and gasoline vapor with essentially no gasoline vapor emission to the ambient atmosphere.

We claim:

1. In a method for removing an oxidizable liquid and related liquid vapor from a storage tank having a closed interior defined by at least one upstanding wall having an exterior side and an interior side, a bottom, and an open top opposing said bottom, said open top being fitted with a floatable external roof that is slidingly sealed to said interior side to keep said vapor from escaping to the ambient atmosphere over said roof and outside said tank interior, said roof carrying a plurality of support legs that extend essentially equidistantly into said tank interior which legs stop said roof and hold it stationary a finite distance apart from said bottom thereby leaving liquid and related vapor remaining between said stationary floating roof and said bottom, said floating roof carrying at least two vents which are in fluid communication through said roof between said tank interior that remains under said stationary floating roof and said ambient atmosphere over said roof, the improvement comprising a method of removing essentially all said remaining liquid from said tank interior under said stationary external roof without creating a vacuum within said interior while removing said related vapor from said interior with minimal emissions to said ambient atmosphere comprising the steps of removing from said interior said remaining liquid, enclosing at least one of said vents in said roof with a first housing, removing through said at least one vent with a first housing from said interior below said stationary external roof said vapor, said vapor removal being effected in a contained manner, transporting said contained vapor to at least one thermal oxidizer, oxidizing said contained vapor to a substantial extent in said at least one oxidizer, emitting to said ambient atmosphere the exhaust of said at least one oxidizer, enclosing at least one other of said vents in said roof with a second housing so that all said at least two vents are closed to said ambient atmosphere, introducing through at least one other of said vents with a second housing at least one inert gas in an amount sufficient to maintain a gaseous pressure between said stationary roof and said liquid in said tank sufficient to prevent the formation of a vacuum in said tank interior as said liquid is removed there from while said floating roof remains stationary, whereby said tank is emptied of essentially all its liquid content without appreciable loss of related vapor to said ambient atmosphere, and without damage to said tank.

2. The method of claim 1 wherein said liquid removal, said vapor removal, and said inert gas introduction are carried out essentially contemporaneously.

3. The method of claim 1 wherein the pressure in said interior of said tank is measured during said liquid and vapor removal steps after said roof has become stationary, and at least one of said vents is opened to said ambient atmosphere if a predetermined over pressure or vacuum level is reached in said interior during said removal steps.

4. The method of claim 1 wherein said liquid is hydro carbonaceous.

5. The method of claim 4 wherein said liquid contains hydrocarbon molecules having up to 12 carbon atoms per molecule.

6. The method of claim 1 wherein said liquid is gasoline.

7. The method of claim 1 wherein said vapor is oxidized in said at least one oxidizer to an extent of at least about 95%.

8. The method of claim 4 wherein said vapor is combusted essentially to water vapor and carbon dioxide.

9. The method of claim 1 wherein said tank walls and roof are curvilinear in configuration.

10. The method of claim 1 wherein said roof becomes stationary at a distance of at least about 7 feet from said bottom.

* * * * *